US011814944B2

(12) United States Patent
Zheng et al.

(10) Patent No.: US 11,814,944 B2
(45) Date of Patent: Nov. 14, 2023

(54) REACTIVE TORQUE AUTOMATIC BALANCING DEVICE FOR SCREW DRILLING TOOL, DRILLING STRING, AND METHOD

(71) Applicants: CHINA PETROLEUM & CHEMICAL CORPORATION, Beijing (CN); SINOPEC RESEARCH INSTITUTE OF PETROLEUM ENGINEERING, Beijing (CN)

(72) Inventors: Deshuai Zheng, Beijing (CN); Menggang Li, Beijing (CN); Chengcheng Niu, Beijing (CN); Xiangyang Zhao, Beijing (CN); Lingling Yu, Beijing (CN)

(73) Assignees: CHINA PETROLEUM & CHEMICAL CORPORATION, Beijing (CN); SINOPEC RESEARCH INSTITUTE OF PETROLEUM ENGINEERING, Beijing (CN)

( * ) Notice: Subject to any disclaimer, the term of this patent is extended or adjusted under 35 U.S.C. 154(b) by 165 days.

(21) Appl. No.: 17/594,750

(22) PCT Filed: Apr. 15, 2020

(86) PCT No.: PCT/CN2020/084952
§ 371 (c)(1),
(2) Date: Apr. 5, 2022

(87) PCT Pub. No.: WO2020/221010
PCT Pub. Date: Nov. 5, 2020

(65) Prior Publication Data

US 2022/0316312 A1 Oct. 6, 2022

(30) Foreign Application Priority Data

Apr. 30, 2019 (CN) ..... 201910361879.5

(51) Int. Cl.
*E21B 44/04* (2006.01)
*E21B 4/00* (2006.01)
(Continued)

(52) U.S. Cl.
CPC ..... *E21B 44/04* (2013.01); *E21B 4/003* (2013.01); *E21B 7/046* (2013.01); *E21B 17/22* (2013.01)

(58) Field of Classification Search
CPC ..... E21B 44/04; E21B 44/06; E21B 4/003
See application file for complete search history.

(56) References Cited

U.S. PATENT DOCUMENTS

2007/0256865 A1 11/2007 Cruickshank
2019/0063157 A1* 2/2019 Gao ..... E21B 4/04

FOREIGN PATENT DOCUMENTS

CN 103485715 A 1/2014
CN 106761480 A 5/2017
CN 108798532 A 11/2018

* cited by examiner

*Primary Examiner* — Kristyn A Hall
(74) *Attorney, Agent, or Firm* — NKL Law; Allen Xue

(57) ABSTRACT

A reactive torque automatic balancing device for a screw drilling tool includes an upper joint (1); a core cylinder (9) having an inner chamber in communication with the screw drilling tool (305) located downstream, so that drilling fluid from the inner chamber of the upper joint (1) flows to the screw drilling tool (305) through the inner chamber of the core cylinder (9) to allow the screw drilling tool to perform drilling; a lower joint (16) fixedly arranged at a lower end of the core cylinder (9); and an automatic balancing assembly, which is arranged between an outer wall of the core cylinder (9) and an inner wall of the upper joint (1), and driven by hydraulic pressure generated by a part of the drilling fluid flowing through the inner chamber of the upper joint (1).

19 Claims, 4 Drawing Sheets

(51) Int. Cl.
*E21B 7/04* (2006.01)
*E21B 17/22* (2006.01)

REACTIVE TORQUE AUTOMATIC BALANCING DEVICE FOR SCREW DRILLING TOOL, DRILLING STRING, AND METHOD

CROSS REFERENCE OF RELATED APPLICATIONS

The present application is a U.S. national stage entry of PCT international application No. PCT/CN2020/084952, filed Apr. 15, 2020, which claims priority of Chinese patent application No. 201910361879.5, entitled "Reactive torque automatic balancing device for screw drilling tool and drilling string containing the same" and filed on Apr. 30, 2019, the entire content of which is incorporated herein by reference.

TECHNICAL FIELD

The present invention relates to the technical field of construction of oil and gas wells, in particular to a reactive torque automatic balancing device for screw drilling tool, a drilling string comprising the device, and a drilling method with the drilling string.

TECHNICAL BACKGROUND

At present, in directional wells and horizontal wells a screw drilling tool is mainly used for controlling wellbore trajectory. During the drilling process, the drill string does not rotate in sliding drilling, so as to ensure stability of the tool face of the screw drilling tool, which, however, will cause a large axial friction between the drill string and a wall of the well. In particular, for horizontal wells with long horizontal sections and extended reach wells, huge axial friction will deteriorate transmission of Weight on Bit (WOB), and cause a low Rate of Penetration (ROP).

In order to solve the shortcomings of a low ROP when the screw drilling tool is used in sliding directional drilling, various technologies have been developed at home and abroad, wherein the main idea thereof is to rotate the drill string to reduce the friction and increase the ROP. In the prior arts, advanced rotary steering tools have been used to effectively control the wellbore trajectory and at the same time drive the drill string in rotation, thus overcoming the shortcomings of sliding steering technology. In this manner, transmission of the WOB is smooth with a high ROP, so that the wellbore can have satisfactory quality. However, the rotary steering tool is an electro-mechanical-hydraulic integrated device, which is expensive to use and maintain, so that the drilling cost can hardly be reduced.

SUMMARY OF THE INVENTION

In view of some or all of the above technical problems existing in the prior arts, the present invention proposes a reactive torque automatic balancing device for a screw drilling tool, a drilling string comprising the device, and a drilling method with the drilling string. The reactive torque automatic balancing device is based on a screw drilling tool, and can drive the drill string in rotation during sliding drilling to transfer the WOB smoothly. In addition, the tool face of the screw drilling tool can be effectively controlled, thus solving the problems such as backing pressure in sliding drilling, low ROP or the like. Moreover, the device has a simple structure and a low cost.

According to a first aspect of the present invention, a reactive torque automatic balancing device for a screw drilling tool is proposed, comprising: a cylindrical upper joint; a core cylinder arranged in an inner chamber of the upper joint, the core cylinder having an inner chamber in communication with the screw drilling tool located downstream, so that drilling fluid from the inner chamber of the upper joint flows to the screw drilling tool through the inner chamber of the core cylinder to allow the screw drilling tool to perform drilling; a cylindrical lower joint fixedly arranged at a lower end of the core cylinder, a part of the lower joint extending out of the inner chamber of the upper joint to be fixedly connected to a housing of the screw drilling tool through a lower drill rod; and an automatic balancing assembly, which is arranged between an outer wall of the core cylinder and an inner wall of the upper joint, and driven by hydraulic pressure generated by a part of the drilling fluid flowing through the inner chamber of the upper joint. When the drilling fluid has a displacement equal to a first predetermined value, the automatic balance assembly enables a friction torque generated between the upper joint and the core cylinder equal to a reactive torque generated on the housing of the screw drilling tool, for performing directional drilling. When the displacement of the drilling fluid is higher than the first predetermined value, the automatic balance assembly enables the friction torque generated between the upper joint and the core cylinder greater than the reactive torque generated on the housing of the screw drilling tool, so that the core cylinder drives the housing of the screw drilling tool in rotation, for performing combined drilling.

In one embodiment, the automatic balancing assembly includes: an annular stator, arranged on the outer wall of the core cylinder and anti-torsionally connected with the inner wall of the upper joint; a corresponding cylindrical rotor arranged below the stator, the rotor being arranged on the outer wall of the core cylinder and connected therewith through teeth; and an annular piston arranged on the outer wall of the core cylinder. The piston is located above the stator to receive a pressure of the drilling fluid, and transmit a thrust force to drive the stator and rotor to approach toward each other axially between the piston and the lower joint, thereby generating the friction torque.

In one embodiment, an annulus between the upper joint and a part of the core cylinder located upstream of the piston forms a hydraulic channel in communication with the inner chamber of the upper joint, and another annulus between the upper joint and a part of the core cylinder located downstream of the piston forms a second space in communication with outer environment. A radial inner side and a radial outer side of the piston are in movable sealing contact with the core cylinder and the upper joint, respectively, so that the piston receives a pressure of the drilling fluid in the hydraulic channel to form a pressure difference between the upper and lower ends of the piston.

In one embodiment, a first convex ring is provided on the outer wall of the core cylinder, and a first elastic member is arranged between the first convex ring and the piston. One end of the first elastic member is fixed to an upper end face of the piston, while the other end thereof is fixed to a lower end face of the first convex ring, so that when the piston is pressed to move downward in the axial direction, the first elastic member generates a pulling force to partially offset the thrust force of the drilling fluid acting on the piston.

In one embodiment, the piston is provided with a nozzle capable of communicating the hydraulic channel with the second space.

In one embodiment, a locking cylinder that is locked with the core cylinder in a circumferential direction thereof is arranged on the outer wall at the upper end of the core cylinder, and extends upward in the axial direction to form an anti-torsional connection with the inner wall of the upper joint. The locking cylinder is configured to move axially when the displacement of the drilling fluid is greater than a second predetermined value, so as to release the anti-torsional connection between the locking cylinder and the upper joint.

In one embodiment, an orifice in communication with the inner chamber of the core cylinder is formed in an inner chamber of the locking cylinder, and has a flow area at an upper end of the orifice larger than that at a lower end thereof. The locking cylinder is provided in its wall with a communication hole, for communicating the inner chamber of the locking cylinder and the hydraulic channel.

In one embodiment, the outer wall of the core cylinder is provided with a second convex ring, and a second elastic member is provided between the second convex ring and the locking cylinder.

In one embodiment, an adjusting cylinder is provided on the outer wall of the core cylinder, and located between the core cylinder and the piston. The adjusting cylinder and the piston are connected with each other in a movable sealing manner.

In one embodiment, an outer wall at a lower end of the piston has a notch, so that a radial size of an upper portion of the piston is greater than that of a lower portion thereof.

In one embodiment, the stator and the rotor have a same axial dimension in a range of 10 to 30 mm.

In one embodiment, the rotor is connected with the outer wall of the core cylinder with teeth, which each have an involute profile and a height not greater than 3 mm.

In one embodiment, between the outer wall of the core cylinder and the inner wall of the upper joint, a bearing is provided above the automatic balancing assembly, the bearing including an outer ring received by a groove formed in the inner wall of the upper joint. The outer wall of the core cylinder is further provided with a third convex ring, which defines an inner ring of the bearing together with a fixing nut, which is arranged above the third convex ring and on the outer wall of the core cylinder.

In one embodiment, the upper joint is configured as a combined structure including an upper joint body and an outer cylinder. An upper end of the outer cylinder extends into an inner chamber of the upper joint body, and form the groove between an upper end face of the outer cylinder and a step surface of the upper joint body.

In one embodiment, an anti-dropping ring is provided at the lower end of the upper joint, and has an upper end inserted into the inner chamber of the upper joint to form a supporting surface at an upper end face of the anti-dropping ring.

In one embodiment, a wear-resistant layer is provided on an inner wall of the anti-dropping ring and located between the anti-dropping ring and the lower joint, wherein a drainage groove extending in the axial direction is provided in the wear-resistant layer.

According to a second aspect of the present invention, a drilling string including the reactive torque automatic balancing device as mentioned above and a screw drilling tool is proposed, wherein the reactive torque automatic balancing device is arranged so that a bottom thereof is 40-60 m away from a top of the screw drilling tool.

According to a third aspect of the present invention, a drilling method with the drilling string as mentioned above, including steps of: pumping, in a case of directional drilling, drilling fluid with a displacement equal to a first predetermined value into the drilling string, whereby a hydraulic pressure generated by a part of the drilling fluid is exerted on the piston of the reactive torque automatic balancing device, so that a friction torque generated between the upper joint and the core cylinder is equal to a reactive torque generated on the housing of the screw drilling tool; and pumping, in a case of combined drilling, drilling fluid with a displacement greater than the first predetermined value into the drilling string, whereby the hydraulic pressure generated by a part of the drilling fluid is exerted on the piston of the reactive torque automatic balancing device, so that the friction torque generated between the upper joint and the core cylinder is greater than the reactive torque generated on the housing of the screw drilling tool.

Compared with the prior arts, the present invention has the following advantages. The reactive torque automatic balancing device is based on the screw drilling tool, and is arranged at a certain distance above the screw drilling tool. When the screw drilling tool is used for sliding directional drilling, the friction torque can automatically balance the reactive torque of the screw drilling tool through the reactive torque automatic balancing device, so as to keep the tool face of the screw drilling tool stable. At the same time, the section of the drill string above the reactive torque automatic balancing device is driven by the rotary table to be in a rotating state, so that the axial friction is greatly reduced while the ROP is significantly increased. Therefore, with the reactive torque automatic balancing device, the tool face of the screw drilling tool can be kept stable while the ROP is greatly increased. When the wellbore trajectory can meet the requirements of design and thus a combined drilling mode is achieved, the friction torque generated by the automatic balancing assembly can be adjusted so that the upper joint can rotate together with the core cylinder and the lower joint, thereby driving the housing of the screw drilling tool to rotate, so that the ROP can be increased. In addition, the reactive torque automatic balancing device has a simple structure, and the cost associated with drilling and maintenance is relatively low.

BRIEF DESCRIPTION OF THE DRAWINGS

In the following preferred embodiments of the present invention will be described in detail with reference to the following drawings, in which.

Figure 1:
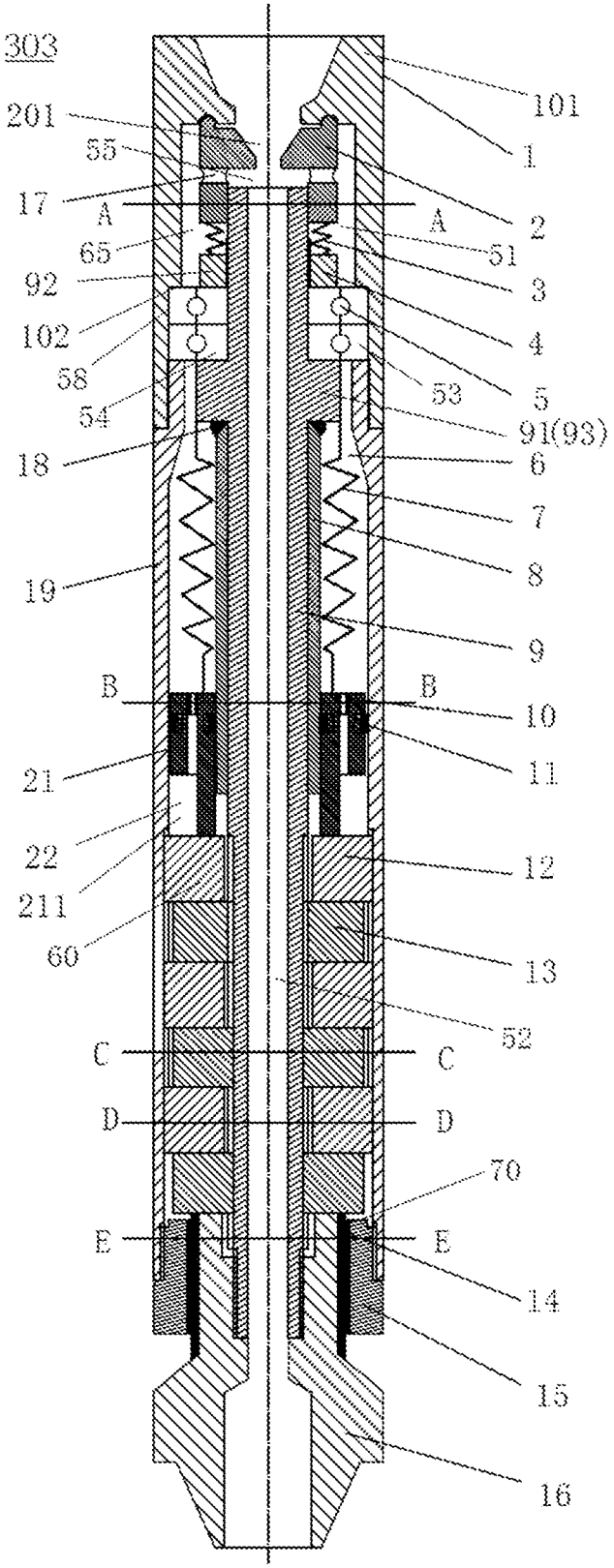
FIG. 1 shows a reactive torque automatic balancing device for screw drilling tool according to an embodiment of the present invention.

In the drawings, the same components are indicated with the same reference signs, respectively. The drawings are not drawn to actual scale.

DETAILED DESCRIPTION OF EMBODIMENTS

The present invention will be described in detail below with reference to the drawings.

Figure 7:
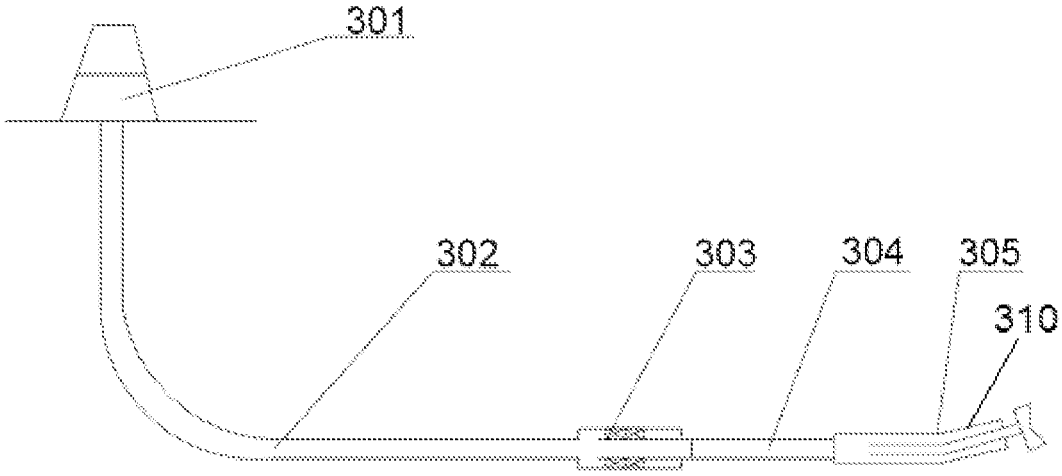
FIG. 7 shows a drilling string according to an embodiment of the present invention.

FIG. 1 shows a reactive torque automatic balancing device 303 for a screw drilling tool 305 according to an embodiment of the present invention. As shown in FIG. 1, the reactive torque automatic balancing device 303 includes an upper joint 1, a lower joint 16, a core cylinder 9, and an automatic balancing assembly 60. Among others, the upper joint 1 has a cylindrical shape, and is used to connect with an upper drilling rod 302 of a drilling string, as shown in FIG. 7. The core cylinder 9 per se also has a cylindrical shape, and is arranged in an inner chamber 51 of the upper joint 1. The core cylinder 9 has an inner chamber 52 in communication with the inner chamber 51 of the upper joint 1. In operation, the inner chamber 52 of the core cylinder 9 is in communication with the screw drilling tool 305 arranged downstream, so that drilling fluid, after being pumped from the inner chamber of the upper joint 1, will flow to the screw drilling tool 305 through the inner chamber 52 of the core cylinder 9, thus allowing the screw drilling toll 305 to perform drilling. The lower joint 16 also has a cylindrical shape, and is fixedly arranged at a lower end of the core cylinder 9. A lower end of the lower joint 16 protrudes from the inner chamber of the upper joint 1, for fixedly connecting with the screw drilling tool 305 through a lower drill rod 304. The automatic balancing assembly 60 is arranged between an outer wall of the core cylinder 9 and an inner wall of the upper joint 1. During the drilling process, a reactive torque will be generated on a housing 310 of the screw drilling tool 305 when the screw drilling tool 305 is drilling forward. A friction torque can be generated by the automatic balancing assembly 60 to counter the reactive torque, when the upper joint 1 rotates, or is inclined to rotate, relative to the core cylinder 9. For example, if the wellbore trajectory meets the design requirements, the friction torque exerted on the core cylinder 9 will be higher than the reactive torque. In this case, the core cylinder 9 drives the lower joint 16 in rotation together with the upper joint 1, thereby driving the housing of the screw drilling tool 305 to rotate and thus increasing the ROP of the drilling string. If the wellbore trajectory deviates from the design and a directional drilling is required, the automatic balancing assembly can generate a friction torque exerted on the core cylinder 9 equal to the reactive torque, so that the upper joint 1 will rotate relative to the lower joint 16. In this case, the tool face of the screw drilling tool 305 can keep stable, and at the same time, a section of the drill string arranged above the reactive torque automatic balancing device 303 is driven by a rotary table to be in a rotatable state, thus greatly reducing the axial friction and significantly increasing the ROP.

Figure 4:
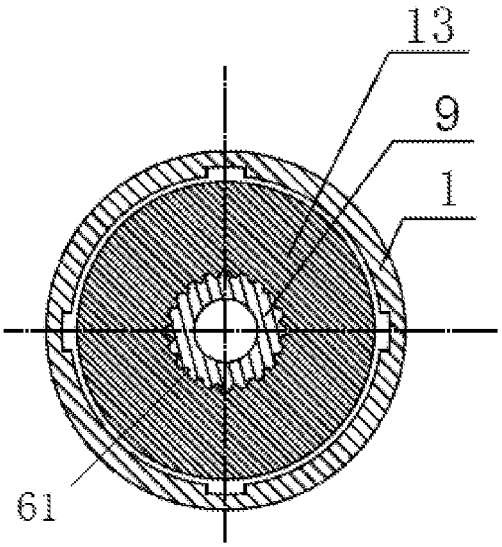
FIG. 4 is a sectional view along line C-C of FIG. 1.
Figure 5:
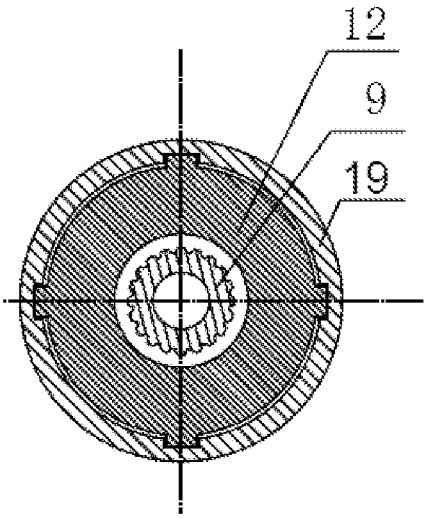
FIG. 5 is a sectional view along line D-D of FIG. 1.

In one embodiment, the automatic balancing assembly 60 comprises at least one stator 12, at least one rotor 13, and a piston 21. Among others, the stator 12 is arranged on the outer wall of the core cylinder 9, and has an annular shape. At the same time, the stator 12 is anti-torsionally connected with the inner wall of the upper joint 1, as shown in FIG. 5, so that the upper joint 1, when rotating, can drive the stator 12 in rotation together. For example, the stator 12 and the upper joint 1 may be anti-torsionally connected with each other in a manner of key-groove engagement. The rotor 13 is arranged on the outer wall of the core cylinder 9, and has an annular shape. At the same time, the rotor 13 is connected with the outer wall of the core cylinder 9 through teeth 61, as shown in FIG. 4, so that the rotor 13 can rotate together with the core cylinder 9. The rotor 13 is positioned in a manner of corresponding to the stator 12, so that the rotor 13 is located downstream of the stator 12. The piston 21 is arranged on the outer wall of the core cylinder 9, and has an annular shape. At the same time, the piston 21 is configured to receive a pressure generated in an annulus 3 between the upper joint 1 and the core cylinder 9, and transmit the pressure to the stator 12 and the rotor 13, so that they are in contact with each other between the piston 21 and the lower joint 16. In this manner, the friction torque is generated between the stator 12 and the rotor 13.

In the present invention, the piston 21 is driven by hydraulic pressure. Specifically, an annulus between the upper joint 1 and a part of the core cylinder 9 upstream of the piston 21 forms a hydraulic channel 6, which can be in communication with the inner chamber of the upper joint 1 for receiving the drilling fluid from the inner chamber of the upper joint 1. An annulus between the upper joint 1 and a part of the core cylinder 9 downstream of the piston 21 forms a second space 22, which can be in communication with outer environment. At the same time, a radially inner side and a radially outer side of the piston 21 are in movably sealing contact with the core cylinder 9 and the upper joint 1, respectively. During normal drilling, the screw drilling tool 305 and the drill bit will generate pressure loss, resulting in a pressure difference generated between the hydraulic channel 6, which is formed between the core cylinder 9 and the upper joint 1, and the second space 22. An upper end face of the piston 21 is in contact with the hydraulic channel 6 (i.e., a high pressure area), while a lower end face thereof is in contact with the second space 22 (i.e., a low pressure area). As a result, the piston 21 will be applied with an action of the hydraulic pressure, causing the stator 12 and the rotor 13 approach to each other in an axial direction, and snugly fit with each other.

In operation, the friction torque exerted on the core cylinder 9 is calculated by:

$$T_f=(\Delta PS-f)n\mu r \tag{1}$$

wherein: $T_f$ is the friction torque; $\Delta P$ is a pressure difference between inner side and outer side, and specifically includes a starting pressure loss $\Delta P_0$, which is dependent on the drilling fluid displacement, and a working pressure loss of the screw $\Delta P_p$; n is the quantity of contact surfaces between the stator 12 and the rotor 13; S is an area of the annular upper end face of the piston 21; f is a spring tension; $\mu$ is a friction coefficient between the stator 12 and the rotor 13; and r is a friction radius of the stator 12 and the rotor 13.

The reactive torque exerted on the core cylinder 9 (i.e., the reactive torque exerted on the housing of the screw drilling tool 305) is calculated by:

$$T_p=\Delta P_p k \tag{2}$$

wherein $T_p$ is the reactive torque of the screw drilling tool 305; $\Delta P_p$ is the working pressure loss of the screw; and k is the characteristic parameter of the screw drilling tool 305.

According to the above expressions, the starting pressure loss $\Delta P_0$ is firstly calculated and determined based on a first predetermined value of the drilling fluid displacement. The spring is configured to provide a tension, which is calculated as follows, when the piston moves downward under the pressure of the drilling fluid until it contacts the uppermost stator:

$$f=\Delta P_0 S \tag{3}$$

After the spring is determined, the first predetermined value of the drilling fluid displacement is determined also. With the tension of the spring, the force of the piston 21 for pressing the stator 12 and the rotor 13 will be related to the working pressure loss of the screw drilling tool 305 only.

Secondly, after determining the sizes of the stator and the rotor and the friction coefficient therebetween, the quantity of the stators 12 and the rotors 13 is calculated, so that the friction torque $T_f$ and the screw reactive torque $T_p$ are equal to each other when the drilling fluid displacement is the first predetermined value. As the WOB and the earth formation change, the reactive torque of the screw drilling tool 305 will change accordingly, but at the same time, the working pressure loss of the screw also changes. In this case, the friction torque generated is always the same as the reactive torque exerted on the housing of the screw drill 305, so that it can be finally achieved that the friction torque could automatically balance the reactive torque of the screw drilling tool 305. In other words, as long as the structure of the reactive torque automatic balancing device is determined, the friction torque generated by the automatic balancing assembly will be always the same as the reactive torque exerted on the housing of the screw drilling tool 305 during the drilling process, which will not be affected by the formation or the drilling state, if the drilling fluid displacement is adjusted as the first predetermined value.

Based on the above principle, when the drilling fluid displacement is equal to the first predetermined value, the tool face of the screw drilling tool 305 is always kept stable. At the same time, the section of the drill string arranged above the reactive torque automatic balancing device 303 of the screw drilling tool is driven by the rotary table to be in a rotatable state. When the drilling fluid displacement is higher than the first predetermined value, the piston 21 is exerted by a greater force to press the stator 12 and the rotor 13 tightly together. At this time, the friction torque exerted on the core cylinder 9 is higher than the reactive torque of the lower joint 16 applying thereon, so that the upper joint 1 can drive the stator 12 to rotate. Because an axial pressure between the stator 12 and the rotor 13 is very large, the rotor 13 will rotate together with the stator 12, so as to drive the core cylinder 9 to rotate. In this manner, the lower joint 16 and the stator of the screw drilling tool 305 are in a rotatable state. In this combined drilling mode, the ROP is high, the stator 12 and the rotor 13 do not rotate with each other, and the screw drilling tool 305 is not able to control the wellbore trajectory. According to the working characteristics of the screw drilling tool 305, the working pressure loss generated by the screw drilling tool 305 is greater as the torque output by the screw drilling tool 305 increases, presenting a proportional relationship therebetween, thus providing a greater pushing force of the piston 21. As the upper joint 1 rotates, the friction torque between the upper joint 1 and the core cylinder 9 is greater, and the direction of the friction torque is clockwise. As long as the magnitude of the friction torque is the same as the reactive torque, the stator of the screw drilling tool 305 is in a torque balance state and thus maintains a non-rotatable state, thereby achieving the directional drilling. That is, based on the above configuration, the operation process of the drilling string can be adjusted by adjusting the drilling fluid displacement, so as to better meet the requirement on the design for the wellbore trajectory.

For example, a plurality of stators 12 and a plurality of corresponding rotors 13 are provided on the outer wall of the core cylinder 9. The lowermost rotor 13 is located to abut the upper end face of the lower joint 16, while the upper end face of the uppermost stator 12 is located to abut the piston 21.

Preferably, the teeth 61 forming the engagement between the rotor 13 and the outer wall of the core cylinder 9 each have a height not greater than 3 mm. For example, the rotor 13 is connected with the core cylinder 9 with shallow teeth that are arranged densely and have involute profiles. This arrangement can not only transmit larger torque, but also reduce the influence on the strength of the core cylinder 9.

A step seal 11 is provided between the outer wall of the piston 21 and the inner wall of the upper joint 1, and also between the inner wall of the piston 21 and the outer wall of the core cylinder 9. This arrangement can ensure the sealing effect between the piston 21 and the upper joint 1, and between the piston 21 and the core cylinder 9, thus preventing liquid in the annulus 3 between the upper joint 1 and the core cylinder 9 from leaking to a position below the piston 21.

Preferably, the stator 12 and the rotor 13 are made of cemented carbide. By means of which, wear resistance of the stator 12 and the rotor 13 can be improved, thereby increasing the service life of the reactive torque automatic balancing device 303. Further preferably, the stator 12 and the rotor 13 have the same axial dimension, which is in a range of 10 to 30 mm, and for example, 20 mm, in order to ensure the strength of the stator 12 and the rotor 13.

Figure 3:
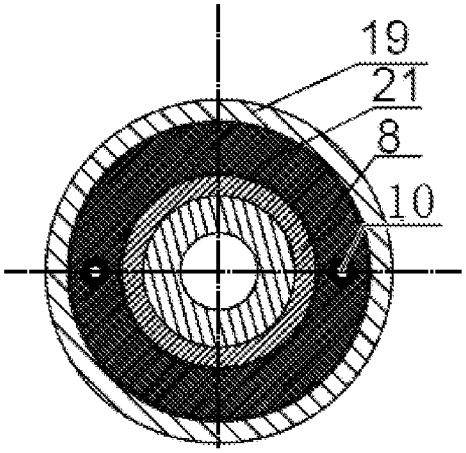
FIG. 3 is a sectional view along line B-B of FIG. 1.

A nozzle 10 is provided on the piston 21 to communicate the hydraulic channel 6 with the second space 22, as shown in FIG. 3. A small amount of the drilling fluid can flow from the hydraulic channel 6 into the second space 22 through the nozzle 10, for cooling the automatic balancing assembly and thus prolonging the service life thereof.

For example, the outer wall at the lower end of the piston 21 has a notch 211, so that a radial size of an upper portion of the piston 21 is greater than that of a lower portion thereof. With this arrangement, the contact area between the piston 21 and the core cylinder 9 is larger than that between the piston 21 and the upper joint 1, so that the piston 21 will be more likely inclined to rotate with the core cylinder 9 instead of with the upper joint 1. In this way, the amount of relative rotation is small, so that the wearing amount of the piston 21 is relatively reduced. In addition, this arrangement can also ensure easy processing, and facilitate operations such as installing the nozzle 10 or the like.

A first convex ring 91 is provided on the outer wall of the core cylinder 9, and a first elastic member 7 is arranged between the first convex ring 91 and the piston 21. For example, the first elastic member 7 may be a tension spring. One end of the first elastic member 7 is fixed to the upper end face of the piston 21, and the other end thereof is fixed to the lower end face of the first convex ring 91. During operation, the piston 21 is also affected by the starting pressure loss and the working pressure loss of the screw drilling tool 305. However, the pulling force generated by the first elastic member can offset the thrust applied by the starting pressure loss on the piston 21. Accordingly, with the pulling force generated by the first elastic member 7, the force of the piston 21 to press the stator 12 and the rotor 13 will be related to the working pressure loss of the screw drilling tool 305 only.

Figure 2:
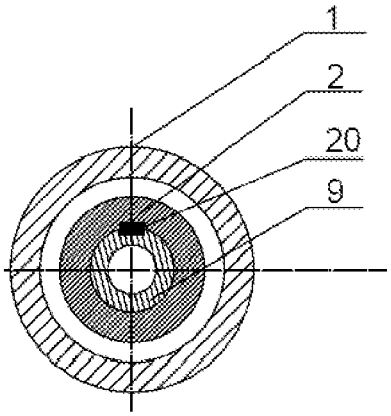
FIG. 2 is a sectional view along line A-A of FIG. 1.

A locking cylinder 2, which is locked with the core cylinder 9 along a circumferential direction, is provided on the outer wall at the upper end of the core cylinder 9. For example, as shown in FIG. 2, the locking cylinder 2 and the core cylinder 9 are connected with each other through a key 20, so that the locking cylinder 2 can move axially relative to the core cylinder 9 but cannot rotate relative thereto along the circumferential direction. The locking cylinder 2 extends upward along the axial direction, thus forming an anti-torsional connection with the inner wall of the upper joint 1, such as four concave-convex engagements evenly distributed along the circumferential direction. An orifice 201 in communication with the inner chamber of the core cylinder 9 is formed in an inner chamber 55 of the locking cylinder 2, and has a flow area at an upper end of the orifice larger than that at a lower end thereof. The wall of the locking cylinder 2 is provided with a communication hole 17, for communicating the inner chamber 55 of the locking cylinder 2 and the hydraulic channel 6. The drilling fluid from the upper joint 1 flows downstream through the orifice 201, so that a part of the drilling fluid enters the inner chamber of the core cylinder 9 while the other part thereof enters the hydraulic channel 6 through the communication hole 17. In addition, a second convex ring 92 is provided on the outer wall of the core cylinder 9, and a second elastic member 3, such as a spring, is arranged between the second convex ring 92 and the locking cylinder 2, for pushing the locking cylinder 2 to connect with the upper joint 1 anti-torsionally. The parameters of the spring can be selected so that when the drilling fluid displacement is greater than a second predetermined value and thus a thrust force generated by the orifice 201 is greater than a counter force generated by the second elastic member 3, the locking cylinder 2 will move downward and disengages from the upper joint 1. Accordingly, the upper joint 1 and the core cylinder 9 are out of engagement, so that said two members can rotate relative to each other freely. The main function of the locking cylinder 2 is as follows. When the drilling fluid displacement is lower than the second predetermined value, the locking cylinder 2 can lock the upper joint 1 with the core cylinder 9 along the circumferential direction, so that the upper joint 1 and the core cylinder 9 share the same state of rotation. When the drilling fluid displacement is higher than the second predetermined value, the upper joint 1 and the core cylinder 9 are out of engagement. Therefore, by means of the locking cylinder 2, it is possible for the upper drilling rod to drive the section of the screw drilling tool 305 below the reactive torque automatic balancing device 303 and the drill bit into rotation when complicated conditions occur in well so that a normal displacement cannot be achieved, or even the pump cannot be started up, thus facilitating treatment of complicated accidents in well. The second predetermined value is much smaller than the first predetermined value. In addition, the second predetermined value of the drilling fluid displacement during drilling in different wellbores can be different for each other. For example, for three of most commonly used wellbores of 311 mm, 215.9 mm and 152 mm, the second predetermined value of the drilling fluid displacement can be 30 L/s, 20 L/s and 15 L/s, respectively.

An adjusting cylinder 8 is provided on the outer wall of the core cylinder 9, and located between the core cylinder 9 and the piston 21. It can be understood that the adjusting cylinder 8, when provided, and the piston 21 are connected with each other in a movable sealing manner. When the sizes of the piston 21 and the core cylinder 9 are determined, the adjusting cylinder 8 can be used to compensate the gap between the piston 21 and the core cylinder 9. For example, an upper end of the adjusting cylinder 8 can be fixedly arranged on the core cylinder 9 through welding spots 18.

In one embodiment, an anti-dropping ring 15 is fixed at the lower end of the upper joint 1. An upper end of the anti-dropping ring 15 is inserted into the inner chamber of the upper joint 1, so as to form a supporting surface 70 at the upper end face of the anti-dropping ring 15. In the event of an accident such as broken bearing, the stator 12 and the rotor 13 will fall down and then be received by the anti-drop ring 15, so that they cannot fall into the wellbore.

Figure 6:
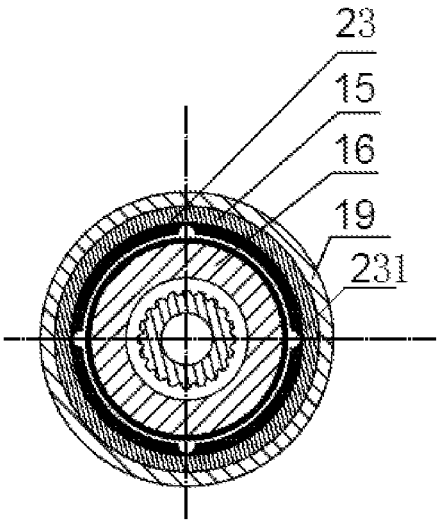
FIG. 6 is a sectional view along line E-E of FIG. 1.

As shown in FIG. 6, a wear-resistant layer 23 is provided on an inner wall of the anti-dropping ring 15, and a wear-resistant layer 14 is further provided on the outer wall of the lower joint 16. In this manner, wear resistance between the anti-dropping ring 15 and the lower joint 16 are improved, thus increasing the service life thereof. In addition, at least one drainage groove 231 extending in the axial direction is provided in the wear-resistant layer 23. For example, four drainage grooves 231 are evenly distributed along the circumferential direction, so as to broaden fluid passage for communicating the second space 22 with outer environment.

In one embodiment, between the outer wall of the core cylinder 9 and the inner wall of the upper joint 1, a bearing 5 is provided above the automatic balancing assembly. The bearing 5 includes an outer ring 53 defined by the inner wall of the upper joint 1, and an inner ring 54 defined by the outer wall of the core cylinder 9. The outer ring 53 is received by a groove 58 formed in the inner wall of the upper joint 1. For example, the upper joint 1 may be configured as a combined structure, that is, it includes an upper joint body 101, and an outer cylinder 19 having an upper end extending into an inner chamber 65 of the upper joint body 101. The outer ring 53 of the bearing 5 is inserted between a step surface 102 formed on the inner wall of the upper joint body 101 and an upper end face of the outer cylinder 19. Moreover, a lower end face of the inner ring 54 of the bearing 5 abuts against a third convex ring 93 arranged on the outer wall of the core cylinder 9, while an upper end face thereof is in contact with a fixing nut 4 arranged on the outer wall of the core cylinder 9. By means of the bearing 5, the outer cylinder 19 and the core cylinder 9 can be rotatable relative to each other freely. At the same time, the bearing 5 can be a thrust bearing for being loaded with axial forces, such as drilling pressure. For example, according to actual needs, multiple bearings 5 can be provided. When the drilling string is used in hard formations and thus a larger WOB is required, the number of bearings 5 can be increased. It should be noted that in order to simplify the structure, the third convex ring 93 and the first convex ring 91 may be formed into one piece, for example, and in this case the fixing nut 4 may function as the second convex ring 92. The third convex ring 93 may have a length of about 20 mm, for ensuring sufficient strength for fixing the bearing 5.

The upper joint 1 may have an upper end designed as a female joint, and another end as a male joint for threaded connection with the outer cylinder 19. The outer diameter of the upper joint 1 is determined according to the size of the wellbore, and normally is about 40 mm smaller than the size of the wellbore, so as to form a flow path for flowback of cuttings.

The upper part of the lower joint 16 is inserted into the inner chamber 51 of the upper joint 1, and is connected to the core cylinder 9 through threaded connection. The upper end face of the lower joint 16 protrudes radially outward with respect to the outer wall of the core cylinder 9, for contacting and receiving the rotor 13 of the automatic balancing assembly. A flow area of a lower part of the inner chamber of the lower joint 16 is larger than that of an upper part thereof, so as to ensure that the flow friction of the drilling fluid is reduced under a certain strength.

The present application further proposes a drilling string and a method. As shown in FIG. 7, the drilling string includes the reactive torque automatic balancing device 303 according to the present application and the screw drilling tool 305. During use, the upper joint 1 of the reactive torque automatic balancing device 303 is connected to a wellhead rotary table 301 and a drilling pump through the upper drilling rod 302, and the lower joint 16 is connected to the housing of the screw drilling tool 305 through a lower drill rod 304. In addition, during the connection, it is necessary to ensure that the reactive torque automatic balancing device 303 is arranged at a distance of 40-60 m from the screw drilling tool 305. For example, the bottom surface of the reactive torque automatic balancing device 303 is 50 m from the top surface of the screw drilling tool 305. When the screw drilling tool 305 is used for sliding directional drilling, the wellhead rotary table 301 of the drilling string is activated, and the drilling fluid displacement is adjusted as the first predetermined value. At this time, the friction torque can just balance the reactive torque of the screw drilling tool 305. Regardless of various factors, such as formations, WOB or the like, that will cause the reactive torque of the screw drilling tool 305 to be changed, a corresponding changing torque can be generated to automatically balance said reactive torque according to the present invention, so that the tool face of the screw drilling tool 305 is always kept stable. The section of the drilling string above the reactive torque automatic balance device 303 for the screw drilling tool is driven by the wellhead rotary table 301 to be in a rotating state, so that the axial friction is greatly reduced and the ROP is significantly increased. Therefore, the reactive torque automatic balance device 303 for the screw drilling tool can maintain the tool face of the screw drilling tool 305 stable, while at the same time significantly increase the ROP. When the screw drilling tool 305 is used for combined drilling, the drilling fluid is pumped into the drilling string with a displacement higher than the first predetermined value. In this case, a part of the drilling fluid will act on the piston 21 of the reactive torque automatic balancing device 303, so that the friction torque generated between the upper joint 1 and the core cylinder 9 is greater than the reactive torque generated on the housing of the screw drilling tool 305. At this time, the upper joint 1 will drive the core cylinder 9 to rotate together, and then drive the housing of the screw drilling tool 305 to rotate together, thereby increasing the ROP.

The foregoing merely discloses preferred embodiments of the present invention, but the protection scope of the present invention is not limited thereto. Changes or modifications within the technical scope disclosed by the present invention are obvious to one skilled in the art, and should fall within the scope of protection of the present invention. Therefore, the scope of protection of the present invention should be determined by the scope of protection of the claims.

The invention claimed is:

1. A reactive torque automatic balancing device for a screw drilling tool, comprising:

a cylindrical upper joint;

a core cylinder arranged in an inner chamber of the upper joint, the core cylinder having an inner chamber configured to be in fluid communication with the screw drilling tool so that a drilling fluid from the inner chamber of the upper joint flows to the screw drilling tool through the inner chamber of the core cylinder to allow the screw drilling tool to perform drilling;

a cylindrical lower joint fixedly arranged at a lower end of the core cylinder, a part of the lower joint extending out of the inner chamber of the upper joint, configured to be fixedly connected to the screw drilling tool through a lower drill rod; and an automatic balancing assembly arranged between an outer wall of the core cylinder and an inner wall of the upper joint, wherein the automatic balancing assembly is driven by hydraulic pressure generated by a portion of the drilling fluid flowing through the inner chamber of the upper joint, wherein, when the drilling fluid has a displacement equal to a first predetermined value, the automatic balance assembly provides a friction torque generated between the upper joint and the core cylinder that is equal to a reactive torque generated on the screw drilling tool, for performing directional drilling, when the displacement of the drilling fluid is higher than the first predetermined value, the automatic balance assembly provides the friction torque generated between the upper joint and the core cylinder that is greater than the reactive torque generated on the screw drilling tool, which causes the core cylinder to drive the screw drilling tool in rotation, for performing combined drilling.

2. The reactive torque automatic balancing device according to claim 1, further comprising:

an annular stator arranged on the outer wall of the core cylinder and is anti-torsionally connected with the inner wall of the upper joint;

a corresponding cylindrical rotor arranged below the stator, the rotor being arranged on and in connection with the outer wall of the core cylinder; and an annular piston arranged on the outer wall of the core cylinder, wherein the piston is located above the stator to receive a pressure of the drilling fluid, and transmit a thrust force to drive the stator and rotor to approach each other axially between the piston and the lower joint, thereby generating the friction torque.

3. The reactive torque automatic balancing device according to claim 2, wherein a first annulus between the upper joint and a part of the core cylinder located upstream of the piston forms a hydraulic channel in communication with the inner chamber of the upper joint, and a second annulus between the upper joint and a part of the core cylinder located downstream of the piston forms a second space in communication with outer environment, wherein a radial inner side and a radial outer side of the piston are in movable sealing contact with the core cylinder and the upper joint, respectively, so that the piston receives a pressure of the drilling fluid in the hydraulic channel to form a pressure difference between the upper and lower ends of the piston.

4. The reactive torque automatic balancing device according to claim 3, wherein a first convex ring is provided on the outer wall of the core cylinder, and a first elastic member is arranged between the first convex ring and the piston, and wherein one end of the first elastic member is affixed to an upper end face of the piston, while the other end thereof is affixed to a lower end face of the first convex ring, so that when the piston is pressed to move downward in the axial direction, the first elastic member generates a pulling force to partially offset the thrust force of the drilling fluid acting on the piston.

5. The reactive torque automatic balancing device according to claim 3, wherein the piston is provided with a nozzle capable of communicating the hydraulic channel with the second space.

6. The reactive torque automatic balancing device according to claim 3, wherein a locking cylinder that is locked with the core cylinder in a circumferential direction thereof is arranged on the outer wall at the upper end of the core cylinder, and extends upward in the axial direction to form an anti-torsional connection with the inner wall of the upper joint, and wherein the locking cylinder is configured to move axially when the displacement of the drilling fluid is greater than a second predetermined value, so as to release the anti-torsional connection between the locking cylinder and the upper joint.

7. The reactive torque automatic balancing device according to claim 6, wherein an orifice in communication with the inner chamber of the core cylinder is formed in an inner chamber of the locking cylinder, and has a flow area at an upper end of the orifice larger than that at a lower end thereof, and the locking cylinder is provided in its wall with a communication hole that connects the inner chamber of the locking cylinder and the hydraulic channel.

8. The reactive torque automatic balancing device according to claim 6, wherein the outer wall of the core cylinder is provided with a second convex ring, and a second elastic member is provided between the second convex ring and the locking cylinder.

9. The reactive torque automatic balancing device according to claim 2, wherein an adjusting cylinder is provided on the outer wall of the core cylinder, and is located between the core cylinder and the piston, wherein the adjusting cylinder and the piston are connected with each other in a movable sealing manner.

10. The reactive torque automatic balancing device according to claim 2, wherein an outer wall at a lower end of the piston has a notch, so that a radial size of an upper portion of the piston is greater than that of a lower portion thereof.

11. The reactive torque automatic balancing device according to claim 2, wherein the stator and the rotor have a same axial dimension in a range of 10 to 30 mm.

12. The reactive torque automatic balancing device according to claim 2, wherein the rotor is connected with the outer wall of the core cylinder with teeth, each tooth having an involute profile and a height not greater than 3 mm.

13. The reactive torque automatic balancing device according to claim 1, wherein, between the outer wall of the core cylinder and the inner wall of the upper joint, a bearing is provided above the automatic balancing assembly, the bearing including an outer ring received by a groove formed in the inner wall of the upper joint, and the outer wall of the core cylinder is further provided with a third convex ring, which defines an inner ring of the bearing together with a fixing nut, which is arranged above the third convex ring and on the outer wall of the core cylinder.

14. The reactive torque automatic balancing device according to claim 13, wherein the upper joint is forms a combined structure comprising an upper joint body and an outer cylinder, wherein an upper end of the outer cylinder extends into an inner chamber of the upper joint body, and forma the groove between an upper end face of the outer cylinder and a step surface of the upper joint body.

15. The reactive torque automatic balancing device according to claim 1, wherein an anti-dropping ring is provided at the lower end of the upper joint, and has an upper end inserted into the inner chamber of the upper joint to form a supporting surface at an upper end face of the anti-dropping ring.

16. The reactive torque automatic balancing device according to claim 15, wherein a wear-resistant layer is provided on an inner wall of the anti-dropping ring between the anti-dropping ring and the lower joint, wherein a drainage groove extending in the axial direction is provided in the wear-resistant layer.

17. A drilling string, comprising the reactive torque automatic balancing device according to claim 1 and a screw drilling tool, wherein the reactive torque automatic balancing device is arranged so that a bottom thereof is 40-60 m away from a top of the screw drilling tool.

18. A drilling method, comprising:

deploying the drilling string of claim 17 downhole; and pumping a drilling fluid with a displacement equal to a first predetermined value into the drilling string to carry out directional drilling, whereby a hydraulic pressure generated by a portion of the drilling fluid is exerted on the piston of the reactive torque automatic balancing device, so that a friction torque generated between the upper joint and the core cylinder is equal to a reactive torque generated on the housing of the screw drilling tool, pumping, when performing combined drilling, drilling fluid with a displacement greater than the first predetermined value into the drilling string, whereby the hydraulic pressure generated by a portion of the drilling fluid is exerted on the piston of the reactive torque automatic balancing device, so that the friction torque generated between the upper joint and the core cylinder is greater than the reactive torque generated on the housing of the screw drilling tool.

19. A drilling method, comprising:

deploying the drilling string of claim 17 downhole; and pumping drilling fluid with a displacement greater than the first predetermined value into the drilling string to carry out combined drilling, whereby the hydraulic pressure generated by a portion of the drilling fluid is exerted on the piston of the reactive torque automatic balancing device, so that the friction torque generated between the upper joint and the core cylinder is greater than the reactive torque generated on the housing of the screw drilling tool.

* * * * *